US006953361B2

(12) United States Patent
Li et al.

(10) Patent No.: US 6,953,361 B2
(45) Date of Patent: Oct. 11, 2005

(54) ELECTRICAL CONNECTOR WITH LATCHING SYSTEM

(75) Inventors: Xiao Li Li, Kunsan (CN); Yi Sheng Lin, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/927,713

(22) Filed: Aug. 27, 2004

(65) Prior Publication Data

US 2005/0048830 A1 Mar. 3, 2005

(30) Foreign Application Priority Data

Aug. 27, 2003 (TW) ..... 92215480 U

(51) Int. Cl.[7] ..... H01R 13/627
(52) U.S. Cl. ..... 439/358; 439/608
(58) Field of Search ..... 439/358, 357, 439/350, 352, 353, 607

(56) References Cited

U.S. PATENT DOCUMENTS 5,011,424 A * 4/1991 Simmons ..... 439/352
5,197,901 A * 3/1993 Hashiguchi ..... 439/352
5,234,357 A * 8/1993 Yamaguchi ..... 439/354
5,941,725 A 8/1999 Brennan et al.
6,056,578 A * 5/2000 Lin ..... 439/358
6,099,339 A 8/2000 Yanagida et al.
6,558,183 B1 5/2003 Ji et al.
6,607,397 B1 * 8/2003 Zhang et al. ..... 439/357
6,776,658 B2 * 8/2004 Tang ..... 439/607

* cited by examiner

*Primary Examiner*—Ross Gushi
*Assistant Examiner*—X. Chung-Trans
(74) *Attorney, Agent, or Firm*—Wei Te Chung

(57) ABSTRACT

An electrical connector (1) includes a terminal module (32), a metallic shield (31) shielding the terminal module, an outer dielectric cover (10) substantially surrounding the shield and a button (40) attached to the cover. The terminal module includes a mating portion (323) having a number of conductive terminals (322) exposed therein. The shield provides a resilient latching beam (20) at a front portion thereof. The latching beam includes a driving portion (22) and an outwardly extending latching portion (21) adjacent to the mating portion. The cover has an inwardly projecting post (111). The button includes an operating base (43) and an actuator arm (41) being pivotally movable about the post to push the button outwardly.

9 Claims, 5 Drawing Sheets

ELECTRICAL CONNECTOR WITH LATCHING SYSTEM

CROSS-REFERENCE TO RELATED APPLICATION

This application is related to U.S. patent application entitled "ELECTRICAL CONNECTOR WITH LATCHING SYSTEM" and assigned to the common assignee.

BACKGROUND OF THE INVENTION

1. Field of the Invention

The present invention generally relates to the art of electrical connectors and more particularly, to a electrical connector provides means for latching an electrical connector with a complementary electrical connector or other connecting device.

2. Description of the Prior Art

In high speed and other telecommunicating and computer applications, shielded input/output (I/O) connectors have been used at connection interfaces between computers and telecommunication networks. It is important to lock or latch two mating connectors to one another for ensuring proper and complete interconnection of the connector terminals and to further ensuring ongoing connections of the connectors. There are a plurality of locking or latching designs or systems available in the art for positively securing a connector to a mating connector. A known type of latching mechanism of a connector is disclosed in U.S. Pat. No. 6,099,339 issued to Yanagida on Aug. 8, 2000. The Yanagida latching mechanism includes a retractable lock pawl and a pair lock release buttons. The locking pawl comprises a resilient metal piece formed into a J-shaped at one end thereof and an operating portion at the other end thereof. The release buttons are positioned at opposite sides of the housing, and each includes a pressing portion at opposite end of a mating face of the connector. When the lock release button is pressed, the pressing portion depresses the operating portion so that the pawl is moved in a lock-releasing the locking.

However, the lock release buttons lack of support and/or securement within the connector and easily to loose away from the housing, thus causing inoperation of the system due to breakage or damage of the components. In addition, such a latching mechanism lacks of enough stretch force for coming back after repeatedly pressed, and can be destroyed if excessive force is applied to the lock release buttons, thus rending the latch mechanism inoperative. Since the lock release buttons are structurally weak and are easily destroyed, the connector has a short life-span.

Hence, an electrical connector with improved latching mechanism is desired to overcome the foregoing shortcomings.

BRIEF SUMMARY OF THE INVENTION

A main object of the present invention is to provide an electrical connector having improved latching mechanism having a relatively long life-span.

Another object of the present invention is to provide an electrical connector having improved latching mechanism, which is reliable and can be easily manufactured assembled An electrical connector includes a terminal module, a metallic shield shielding the terminal module, an outer dielectric cover substantially surrounding the shield and a button attached to the cover. The terminal module includes a mating portion having a number of conductive terminals exposed therein. The shield provides a resilient latching beam at a front portion thereof. The latching beam includes a driving portion and an outwardly extending latching portion adjacent to the mating portion. The cover has an inwardly projecting post. The button includes an operating base and an actuator arm being pivotally movable about the post to push the button outwardly.

Other objects, advantages and novel features of the invention will become more apparent from the following detailed description when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures.

DETAILED DESCRIPTION OF THE INVENTION

Figure 1:
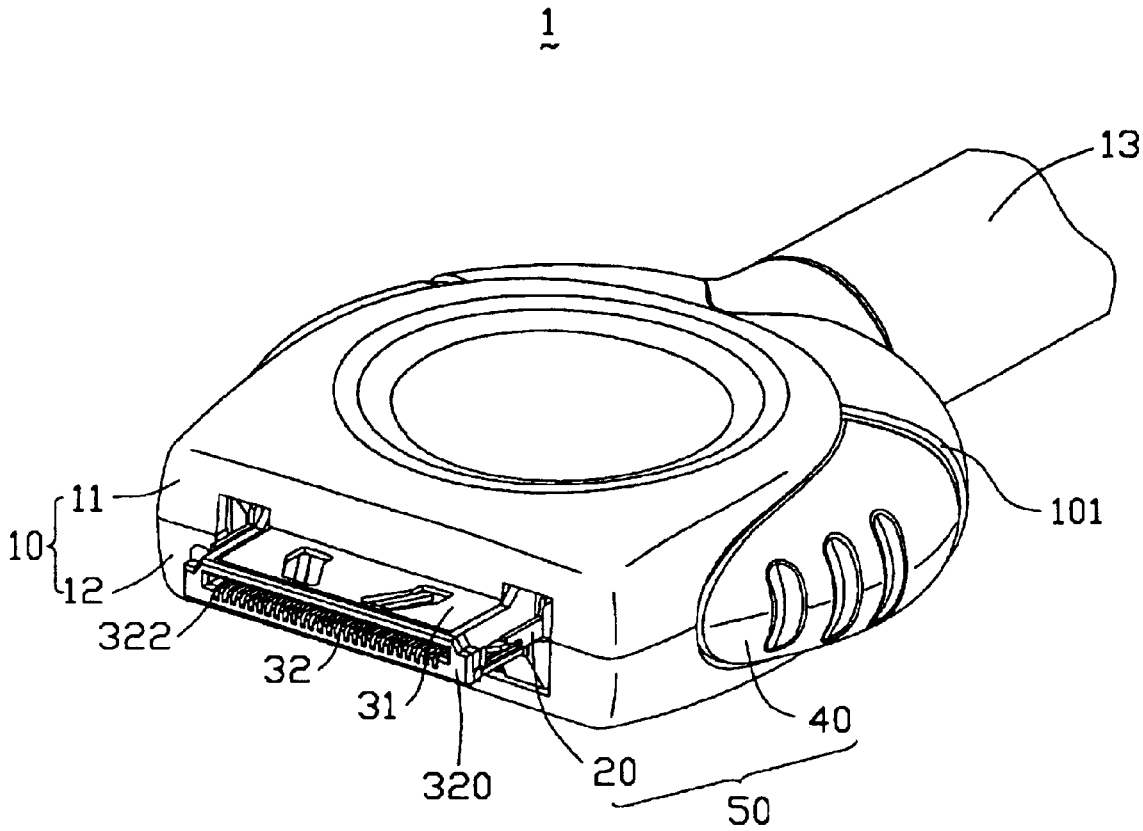
FIG. 1 is a perspective view of an electrical connector according to the present invention.

Referring to the drawings in greater detail, and first to FIG. 1, the invention is embodied in an electrical connector, generally designated 1, which is an input/output (I/O) shielded connector specifically adapted for mating with a complementary connector. The electrical connector 1 comprises a dielectric cover 10, a terminal module 32, a metallic shield 31 shielding the terminal module 32 and a pair of latching mechanisms 50 positioned in opposite sides of the dielectric cover. However, it should be understood that various features of the invention are equally applicable for other types of connectors, as will be fully understandable from the following detailed description.

Figure 2:
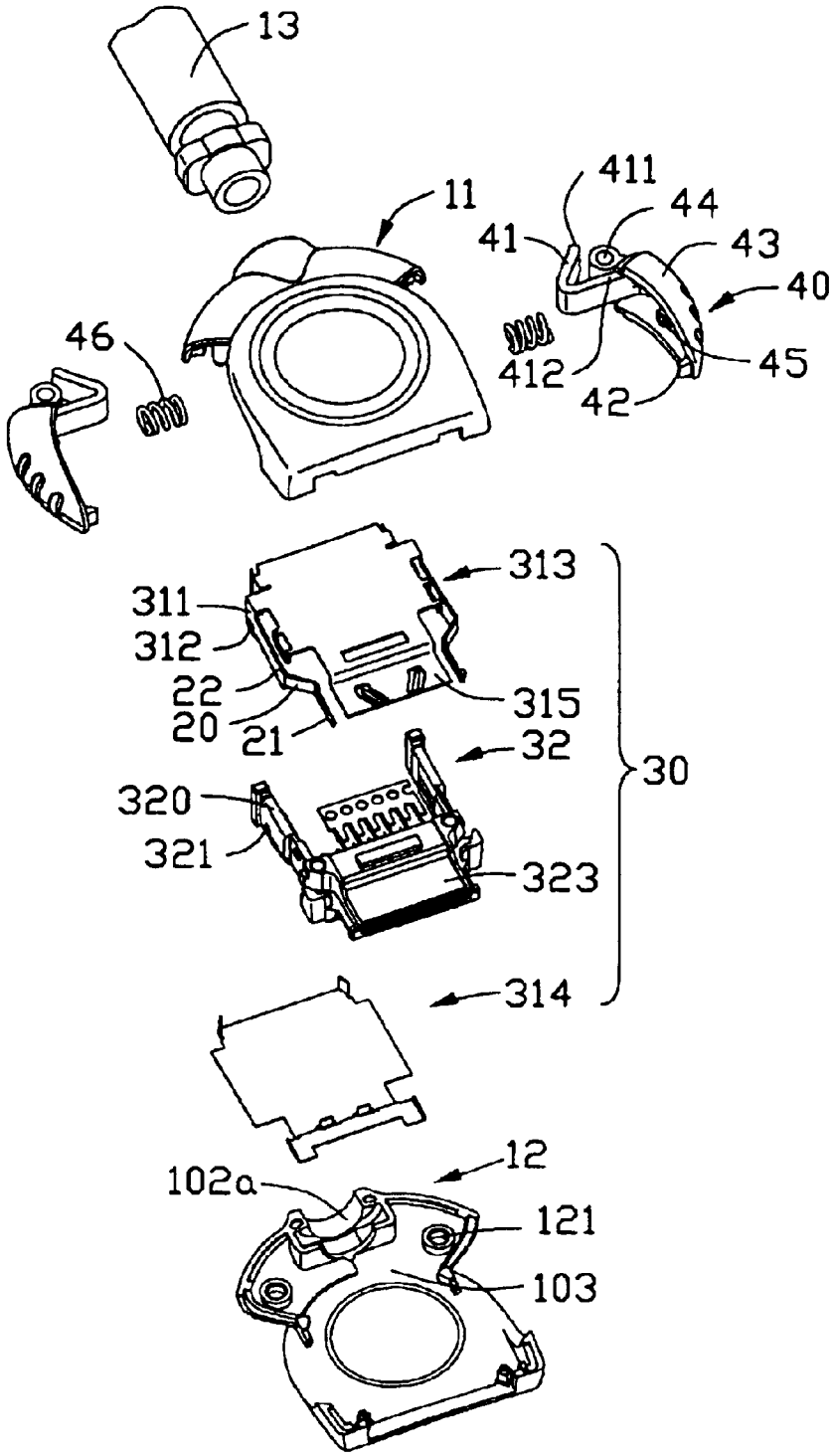
FIG. 2 is an exploded view of FIG. 1.
Figure 3:
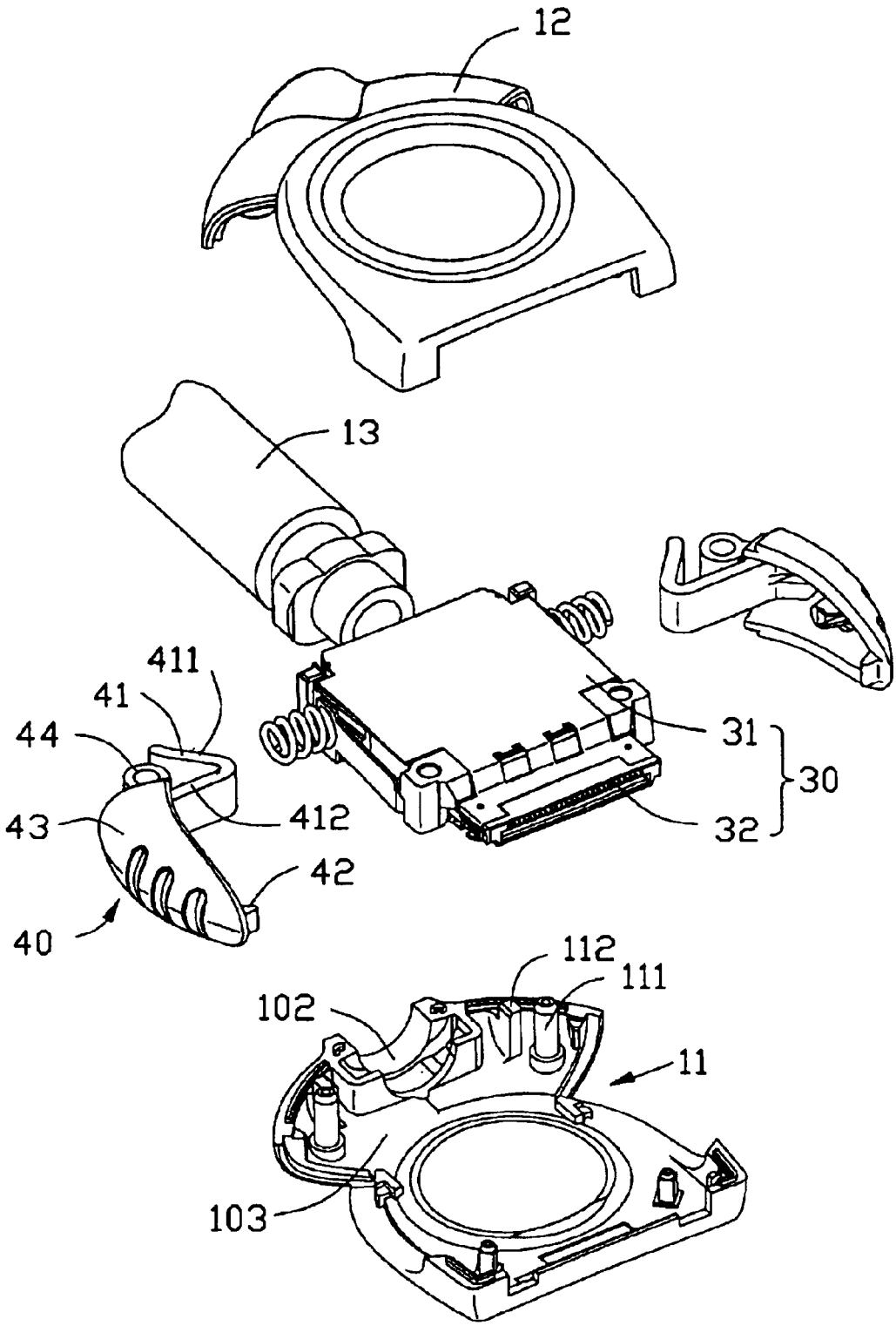
FIG. 3 is another exploded view of FIG. 1.

Referring to FIGS. 2 and 3 in conjunction with FIG. 1, the cover 10 is formed by a pair of split cover halves, namely an upper cover 11 and a lower cover 12. The lower cover 12 is coupled to the upper cover 11, thereby forming a receiving space 103 therebetween for receiving the terminal module 32 and the shield 31. A pair of cavities 101 are defined through opposite sides of the cover 10 for receiving the latching mechanisms 50. Each cover half 11, 12 is a one-piece structure unitarily molded of dielectric material such as plastic or the like. The upper cover 11 comprises an upper boot half 102 at a rear end thereof, a pair of posts 111 and a pair of upright extending stopper portions 112 adjacent to the upper boot half 102. The upper boot half 102 has a center axis in common with the upper cover 11. The posts 111 project upright from an inner face of the upper cover 11 adjacent to the upper boot half 102. The stopper portions 112 are mirror images of the center axis on opposite sides of the inner surface of the upper boot half 102.

As best seen in FIG. 2, the lower cover 12 includes a lower boot half 102*a* for cooperating with the upper boot half 102 to hold the cable 13 therebetween, as will be discussed hereinafter, and a pair of locating holes 121 corresponding to the posts 111 of the upper cover 11.

Figure 5:
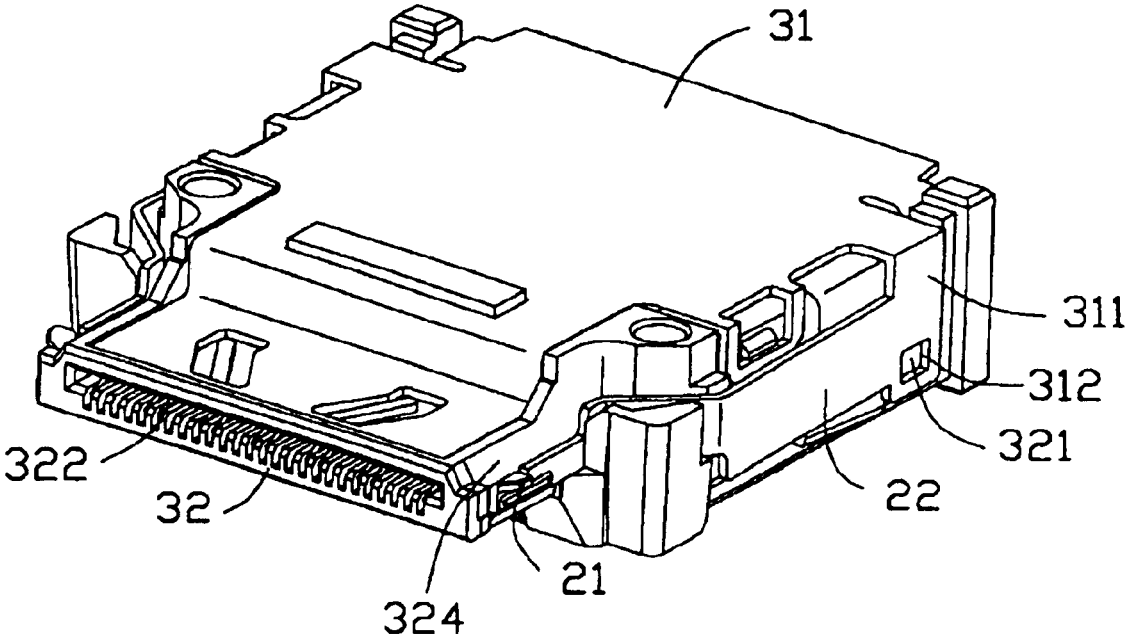
FIG. 5 is a perspective view of FIG. 2, wherein a terminal module and a shield are assembled together.

Referring to FIGS. 2, 3 and 5 in conjunction with FIG. 1, the terminal module 31 includes an insulator 320, an internal PCB (shown in FIG. 2, not labeled), a plurality of conductive terminals 322 received in the insulator 320 and electrically connecting a front portion of the internal PCB, and a cable 13 electrically connecting with a rear portion of the internal PCB by a known process such as soldering etc. The insulator 320 is one-piece structure unitarily molded of dielectric material such as plastic or the like. The insulator 320 has a mating portion 323 partially extending beyond the cover 10. The mating portion 323 provides a narrow slot (not labeled) for receiving a mating portion of the complementary mating connector and a pair of grooves 324. The insulator 320 further has a pair of outwardly projections 321 projecting from opposite side thereof.

Referring to FIGS. 2 and 5 in conjunction with FIG. 3, the metallic shield 31 includes an upper shield 313 and a lower shield 314 coupled to the upper shield 313. The upper shield 313 and the lower shield 314 are formed of sheet metal material as one-piece structures respectively. The upper shield 313 includes a top plate (not labeled) having a front lip 315 and a pair of flaps 311 extending downwardly from opposite sides of the top plate. Each flap 311 is adjacent to a rear end of the top plate and defined a detent opening 312 for snapping engagement with respective one of the projections 321 of the insulator 320. The front lip 315 is sized and configured for overlying the top of the mating portion 323 of the insulator 32. The upper shield 313 further has a pair of resilient latching beams 20 forwardly extending from corresponding flaps 311. The latching beams 20 will be described in greater detail hereinafter in conjunction with FIG. 4.

Figure 4:
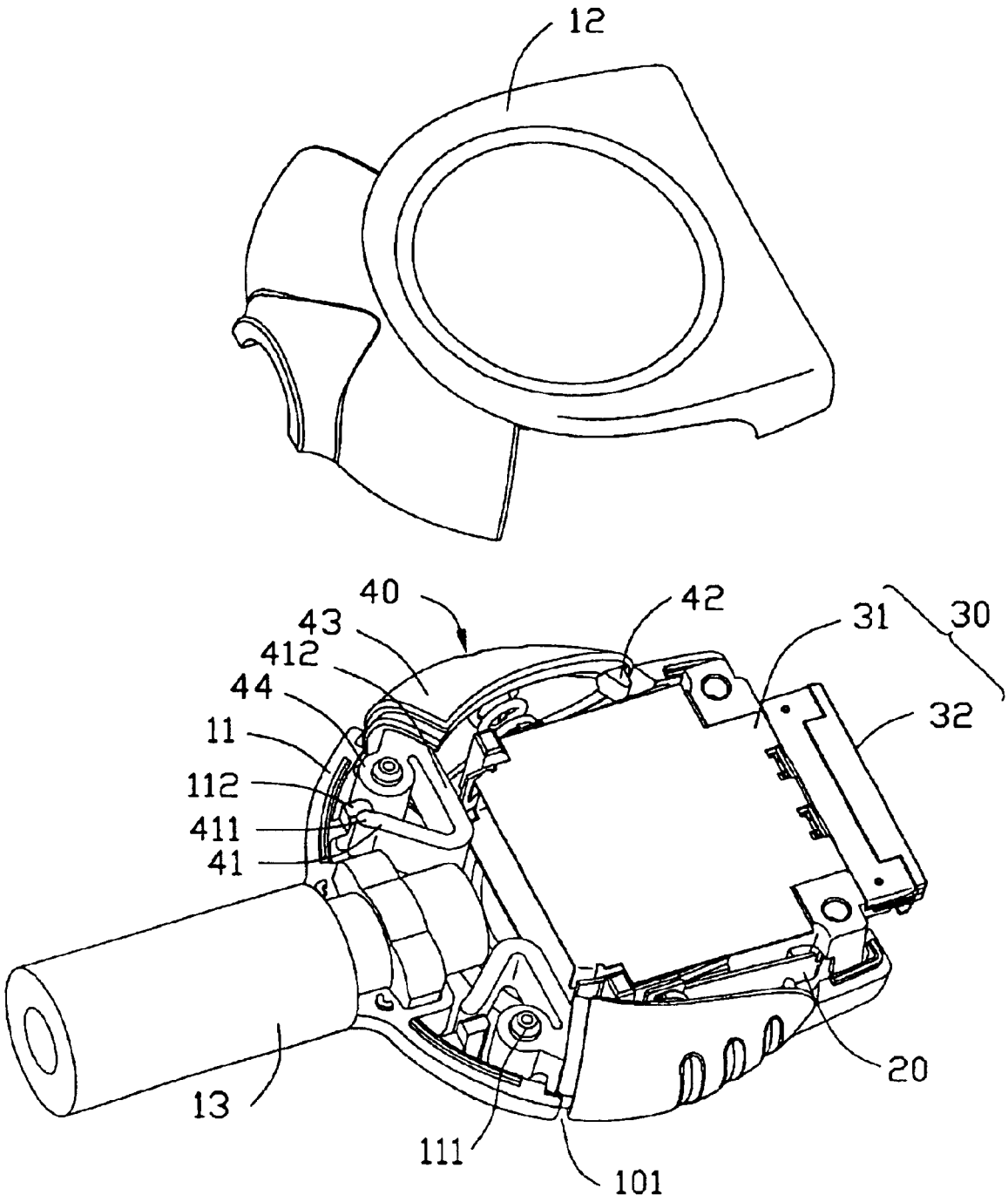
FIG. 4 is an assembled view of FIG. 2, an upper cover being raised for clarity.

Referring to FIGS. 2, 3 and 4, each latching mechanism 50 comprises a button 40, a spring 46 and the latching beam 20 shaped integrally with the flap 311 of the shield 31. The button 40 has an operating base 43 which is substantially quarter-cartouche shaped. A plurality of raised serrated bosses (not labeled) is provided on outer surfaces of each operating base 43 for engagement by an operator's thumb or finger. A front end of each operating base 43 provides a pressing portion 42 inwardly projecting for engaging with the latching beam 20. A rear end of each operating base 43 provides a sleeve 44 for pivotally movable about the post 111 of the upper cover 11 in direction of double-headed arrow "A" (FIG. 4). A resilient actuator arm 41 is configured substantially V-shaped adjacent to the sleeve 44 of the button 40. The actuator arm 41 includes a first leg 412 unitarily molded with the operating base 43, and a cantilevered second leg 411 bent at an acute angle relative to the first leg 412. An inwardly projecting rod 45 is sized and shaped integrally with a middle portion of the operating base 43 for securement within and bias against the spring 46.

As best shown in FIG. 2 in conjunction with FIGS. 3, 4 and 5, each latching beam 20 has a driving portion 22 integrally shaped with the flap 311 of the shield 31. An outwardly projecting latching portion 21 is provided from a distal end of each latching beam 20. The latching portions 21 are adapted for engagement with appropriate latch means of the complementary mating connector. The driving portion 22 actuated by the pressing portion 42 of the button 40, thereby urging the latching portion 21 inwardly toward the mating portion 323 to unlatch and unmate with the complementary connector.

Referring to FIGS. 1=–5, in assembly, the shield 31 is affixed around the terminal module 32 before the terminal module 32 are installed in the receiving space 103 of the cover 10. The projections 321 of the insulator 320 are interference fitted within the detent openings 312 of the upper shield 313. The latching beams 20 are positioned along opposite sides of the insulator 320 with the latching portion 21 projecting out of the groove 324. The terminal module 32 is positioned between the upper shield 313 and the lower shield 314, thereby forming an insert module 30. The insert module 30 is held in the upper cover 11. The mating portion 323 extends beyond a front portion of the upper cover 11 for mating with the complementary connector. The cable 13 is received in the upper boot half 102 of the upper cover 11.

The buttons 40 are assembled in respective ones of the cavities 101 and exposed to outside of the cover 10 after the springs 46 engages with the rod 45 of the buttons 40 respectively. The posts 111 of the upper cover 11 extend through the corresponding sleeves 44. The second legs 411 of the actuator arms 41 are closed to the stopper portions 112 of the cover 10 at a normal position. The pressing portions 42 are closed to the driving portions 22 of the latching beams 20, respectively. The springs 46 are attached to the buttons 40 and abut against the corresponding flaps 311 of the upper shield 313 for providing enough release strength to push the buttons 40 to normal positions, whereby the button 40 can robustly and pivotally move about the corresponding posts 111 of the upper cover 11 in direction of double-headed arrow "A" (FIG. 4).

The lower cover 12 couples to the upper cover 11. Distal ends of the posts 111 engage with the locating holes 121 respectively. The lower boot half 102*a* are attached to the upper boot half 102, thereby securement held the insert module and the buttons 40 within.

As best shown in FIG. 4 in conjunction with the FIG. 1, when the electrical connector mates with the complementary connector, the operating bases 43 are pressed and urges the actuator arms 41 and the springs 46 to move inwardly. The pressing portions 42 of the buttons 40 drive the driving portions 22 of the latching beams 20 inwardly, thereby rendering the latching portion 21 received in the grooves 324 and allowing the mating occurs. When the mating completed, the actuator arms 41 and the springs 46 are released and urge the buttons 40 and the press portion 42 move outwardly, thereby the latching portion 21 of the electrical connector 1 respectively engage with counterpart locking portions of the complementary connector to secure the connector 1 to the complementary connector. It can be seen that when the buttons 40 are inwardly depressed, the actuator arms 41 outwardly pivot about the corresponding posts 111 to stop at the stopper portions 112, and the second legs 411 of the actuator arms 41 are elastically distorted to abut against the stopper portions 112. When the inwardly depressed buttons 40 are set free, the distorted actuator arms 41 expand to push outwardly the buttons 40 to normal positions.

Similarly, to disengage the electrical connector 1 from the complementary connector, the buttons 40 are inwardly depressed, the pressing portion 42 of the buttons 40 inwardly deflect the driving portion 21 of the latching beam 20 thereby disengaging the latching portion 22 from the counterpart lock portions of the complementary connector and releasing the electrical connector 1 from the complementary connector.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a terminal module having an inner dielectric insulator and a plurality of conductive terminals mounted in the insulator, the insulator including a forwardly projecting mating portion;

a metallic shield substantially surrounding the inner insulator and including a resilient latching beam, the latching beam being adjacent to a side of the mating portion and including a driving portion and an outwardly extending latching portion;

an outer dielectric cover surrounding a major portion of the shield, the outer dielectric cover including a post and a stopper portion;

a button pivotally attached to the cover, the button including an operating base, a sleeve holding the post therein and is pivotably movable about the post and a resilient actuator arm integrally formed with the operating base; wherein when the operating base is inwardly depressed, the resilient actuator arm is pivotally movable about the post of the outer cover and is elastically stopped at the stopper portion.

2. The electrical connector according to claim 1, wherein the button further has a pressing portion inwardly projecting for engaging the driving portion of the shield to urge inwardly the latching portion toward the mating portion.

3. The electrical connector according to claim 1, wherein the operating base is substantially quarter-cartouche shaped.the stopper portion.

4. The electrical connector according to claim 1, further comprising a spring for pushing the button to a normal position.

5. The electrical connector according to claim 1, wherein the button includes a rod engaging with the spring.

6. The electrical connector according to claim 1, wherein the actuator arm includes a first leg unitarily molded with the operating base, and a cantilevered second leg bent at an angle relative to the first leg.

7. The electrical connector according to claim 6, wherein the second leg of the actuator arm of the button engages with the stopper portion.

8. The electrical connector according to claim 1, wherein the terminal module has an internal PCB and a cable connecting with the PCB.

9. The electrical connector according to claim 8, wherein the cover has a boot portion for securely holding the cable.

* * * * *